United States Patent [19]

Levy et al.

[11] Patent Number: 4,501,360

[45] Date of Patent: Feb. 26, 1985

[54] PACKING, IN PARTICULAR FOR TRANSPORTING AND DISPATCHING PRODUCTS, FOR EXAMPLE BIOLOGICAL PRODUCTS

[76] Inventors: Claude Levy, 14 rue des Bernardins, 75005 Paris; Jean-Philippe Duchesne, 10 rue Manin, 75019 Paris, both of France

[21] Appl. No.: 602,075

[22] Filed: Apr. 19, 1984

[30] Foreign Application Priority Data

Apr. 27, 1983 [FR] France ..... 83 06902

[51] Int. Cl.[3] ..... B65D 85/42; B65D 1/24

[52] U.S. Cl. ..... 206/443; 206/1.5; 206/446; 220/306; 435/296

[58] Field of Search ..... 206/1.5, 443, 446; 220/23.4, 4 E, 306; 435/296, 300, 287

[56] References Cited

U.S. PATENT DOCUMENTS

| | | | |
|---|---|---|---|
| 2,695,723 | 11/1954 | Waterman | 220/4 E |
| 3,168,953 | 8/1961 | Omer, Jr. | 206/419 |
| 3,446,342 | 3/1967 | Michel | 206/232 |
| 3,640,437 | 2/1972 | Galy | 206/446 |
| 3,744,661 | 7/1973 | Fischer, Jr. | 206/446 |
| 3,819,081 | 6/1974 | Runte | 206/627 |
| 4,004,734 | 1/1977 | Hadtke | 220/306 |
| 4,240,547 | 12/1980 | Taylor | 206/443 |

FOREIGN PATENT DOCUMENTS

| | | |
|---|---|---|
| 1144614 | 10/1957 | France . |
| 2134729 | 12/1972 | France . |
| 2155077 | 5/1973 | France . |
| 2207834 | 6/1974 | France . |
| 930607 | 7/1963 | United Kingdom . |
| 1045952 | 10/1966 | United Kingdom . |

*Primary Examiner*—William T. Dixson, Jr.

*Attorney, Agent, or Firm*—Martin P. Hoffman; Karen M. Gerken; Mitchell B. Wasson

[57] ABSTRACT

The packing, in particular for transporting and dispatching for example biological products, comprises a case body 1 subdivided into suitably calibrated receiving cavities 2, 3, 4 for receiving containers (for example tubes 7) of the products to be transported, at least a cover 11 capable of being fitted on said case body and so shaped as to cooperate with the latter for immobilizing the containers placed in said cavities, and detachable locking devices for locking said cover on said case body, said locking devices made inaccessible in the course of transportation. Application in the posting of biological or laboratory products which are precious, dangerous, or toxic.

8 Claims, 3 Drawing Figures

PACKING, IN PARTICULAR FOR TRANSPORTING AND DISPATCHING PRODUCTS, FOR EXAMPLE BIOLOGICAL PRODUCTS

The present invention relates to a packing, in particular for transporting and dispatching various products, for example biological products, such as laboratory human samples, as usually occurs for the transmission thereof for medical analysis purposes.

These sample or specimen products, such as blood, urine, anatomical parts in suspension in preserving liquids, etc., are now often dispatched by post.

Packings already exist for this purpose which are usually made from a semi-rigid material, for example plastics material. Unfortunately, it has been found that when transmitted through the post (or other means of transport), these known packings were not sufficiently strong and it occurred that the transported products were destroyed and rendered useless since said packings did not sufficiently protect these products or their containers (usually tubes).

The criticisms of said packings, by the users or by the postal services (protection of the postal workers or the public), are the following:

(A) Excessive flexibility and lack of strength which are the cause of the breakage of the containers which are susposed to be protected by said packings.

(B) Non-fluidtightness of the packing itself, whence a possible dangerous spreading of the liquids or the products contained in the containers after an accidental internal breakage.

(C) Accidental opening of the packing itself, even when inserted in a second protective envelope (usually in Kraft paper lined with an alveolate plastics sheet).

(D) A non-calibrated inner volumn of the packing causing the rattling of the containers and increased transporting risks.

(E) Format of the packing is not always adapted to standard postal sizes.

The packing according to the invention overcomes the aforementioned drawbacks and satisfies transport safety conditions and the requirements of the Postal Services.

Such a packing is characterized in that it comprises a case body subdivided into cavities which are suitably calibrated and capable of receiving the containers (for example tubes) of the products to be transported, at least a cover adaptable on said case and so shaped as to cooperate with the latter so as to immobilize the containers in said cavities, and detachable locking means for retaining said cover on said case, said means being inaccessible during transportation.

Further features and advantages of the invention will be apparent from the following description and the claims, with reference to the accompanying drawing, in which:

Figures 1, 2, 3:
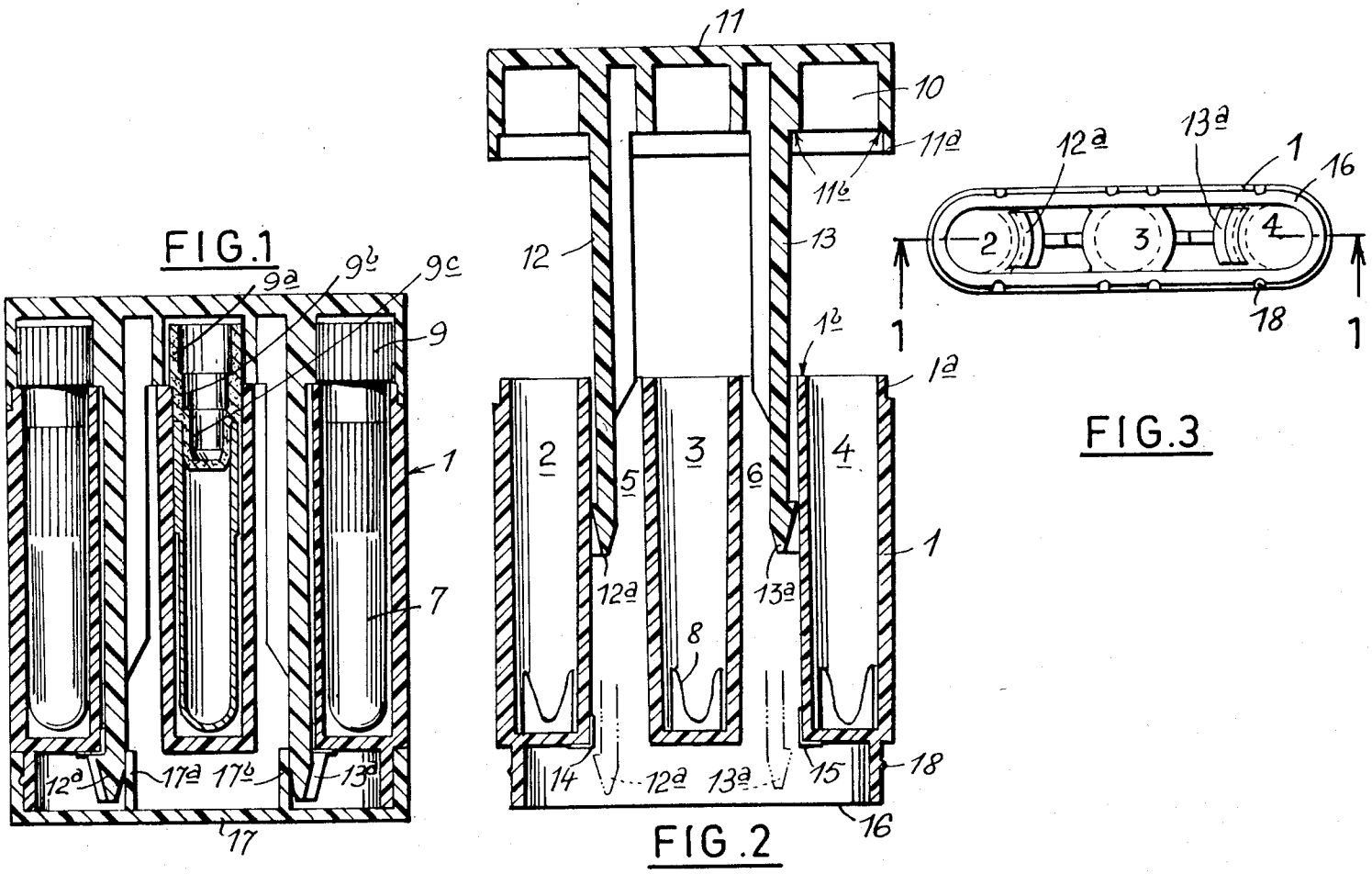
FIG. 1 is a vertical sectional view in a median plane of a complete case according to the invention containing three tubes which are inserted and held in position in their respective cavities.
FIG. 2 is a corresponding view with the tubes in position in their cavities and the cover illustrated in course of positioning on the case.
FIG. 3 is a top plan view of the case, according to FIG. 1 the complementary top cover having been removed.

In the embodiment shown in the accompanying drawing, the case body 1 is advantageously moulded from low-pressure polyethylene. These bodies have for example, three adjacent cavities 2, 3, 4. The central cavity 3 is separated from the cavities 2 and 4 by alveolate spaces respectively 5 and 6. The spaces 5 and 6 open onto the upper part of the case 1.

The cavities 2, 3, 4 are capable of each receiving a tube such as 7, their calibration being such that each tube is easily placed therein but relatively closely so as to avoid any shaking.

In fact, as will be explained hereinafter, each tube is blocked under axial pressure between its two ends, on one hand by its bottom, against a spider 8 moulded in the lower end of each cavity (this spider being relatively flexible and and, on the other hand, by its head, and more precisely its closing plug 9, in a complementary recess 10 formed inside the main cover 11 which is fitted on the case 1.

There have thus been provided in the cover 11 three recesses 10 for capping the three plugs 9 of the three tubes 7.

The cover 11 has two locking strips 12 and 13 which are respectively inserted in the spaces 5 and 6 so that, at the end of the positioning of the cover on the case, the ends 12*a* and 13*a* of the strips hook onto the outer steps 14 and 15 provided in the lower part of the cavities 2 and 4.

The bottom of the case 1 is open and defined by a peripherial skirt 16 so as to permit access of the fingers to the ends 12*a* and 13*a* of the strips 12 and 13. A simultaneous pressure exerted on these ends in a direction to cause them to move toward each other, permits an unlocking and the extraction of the cover 11 from the case 1.

The bottom cover 17 (FIG. 1) which is capable of being fitted on the skirt 16, enables the bottom of the case to be closed so as to prevent accidental access to the locking means 12*a* and 13*a*. Safety steps 17*a* and 17*b* provided inside the cover 17 moreover block the ends 12*a* and 13*a* in the direction for ensuring an improved locking.

As can be seen in the central part of FIG. 1, the plug 9 of each tube 7 is hollow and includes three successive cylindrical bearing portions of decreasing diameters, namely:

a bearing portion 9*a* of the largest diameter which is the portion which can be taken hold of with the fingers and which is trapped in the corresponding recess 10 of the cover 11; the lower edge of this bearing portion bearing against the upper edge of the cavaties 2, 3, or 4;

a bearing portion 9*b* which is engaged in a fluidtight manner in the upper part of the cavity 2, 3, or 4; upon the closure of the tubes it moreover bears against the upper edge of said tubes;

a bearing portion 9*c* engaged in a fluidtight manner in the upper part of the tubes 7.

Therefore each plug 9 performs a double sealing function: namely a sealing of the tube itself (bearing portion 9*c*), sealing of the cavity itself (bearing portion 9*b*).

Thus, even if the tube (made for example from polycarbonate) is accidentally broken, its contents remain enclosed in a sealed manner in the corresponding cavity.

In the worst circumstances, if the head of the plug is itself broken, the seal would still be ensured by the fitting of the cover 11 on the case 1, since the edge 11*a* is applied on the corresponding edge 1*a* and the edge 11*b* is applied against the corresponding edge 1*b*.

It will be observed that the complementary bottom 17 is locked in the skirt 16 by small flexible lugs 18 of the skirt 16 which engage in small complementary cavities provided in the internal periphery of the bottom cover 17.

It must be understood that any modifications may be made in the embodiments just described without departing from the scope of the invention defined in the appended claims.

What is claimed is:

1. A packing, in particular for transporting and dispatching products, for example biological products, said packing comprising a case body subdivided into suitably calibrated receiving cavities, containers for the products to be transported disposed in said cavities, at least a cover having an internal profile capable of fitting on said case body and so shaped as to cooperate with said case body, said internal profile being capable of individually immobilizing said containers in said cavities under axial compression of said containers and rendering said cavities fluidtight, even in the event that said containers become broken inside said cavities, and detachable locking means for temporarily locking said cover to said case body, said locking means being inaccessible in the course of transportation of said packing.

2. A packing according to claim 1, wherein said containers are tubes.

3. A packing according to claim 2, comprising a relatively flexible and deformable spider moulded in a lower end of each cavity, a recess complementary to each cavity formed inside the cover fitted on the case body, each tube being blocked in position under axial pressure between the two ends thereof by engagement of a bottom of the tube against the corresponding spider and engagement of a head end of the tube, constituted by a tube-closing plug, in the corresponding recess in the cover.

4. A packing according to claim 3, comprising three of said recesses in the cover for capping the three plugs of the three tubes in three of said cavities.

5. A packing according to claim 3, wherein said cover includes two locking strips, the case body defines spaces in means defining said cavities, said locking strips being engageable in said spaces when said cover is fitted on said container body, said locking strips having hooking end portions and said means defining said cavities including outer steps onto which steps said hooking end portions of said locking strips are capable of hooking for holding said case on said body when said cover is in a case body-closing position.

6. A packing according to claim 3, wherein said case body is open at a bottom end of said case body and defines a peripheral skirt around the open end of said case body so as to permit access of the fingers of the user to said hooking end portions of said locking strips.

7. A packing according to claim 6, comprising a bottom cover capable of being fitted on said skirt for the purpose of closing the open bottom end of said case body for preventing accidental access to said locking means.

8. A packing according to claim 6, wherein the plug of each tube is hollow and defines three successive shoulders formed by three successive cylindrical portions having decreasing diameters each of which three cylindrical portions being cooperative with three respective portions of said cover, said case body, and said tube which surround said three cylindrical portions so as to maintain under tight conditions, and simultaneously seal, the tubes and the cavities, each plug thus performing from the sealing point of view two essential complementary functions, namely rendering fluidtight the tubes and moreover in addition, rendering fluidtight the cavities in the event that the tubes become broken in said cavities.

* * * * *